United States Patent [19]

Rogers

[11] Patent Number: 4,543,813

[45] Date of Patent: Oct. 1, 1985

[54] METHOD OF MAKING VALVE SLEEVES

[75] Inventor: Peter R. Rogers, Chepstow, Wales

[73] Assignee: TRW Cam Gears Limited, Avon, England

[21] Appl. No.: 533,638

[22] Filed: Sep. 19, 1983

[51] Int. Cl.[4] ..... B21D 22/00

[52] U.S. Cl. ..... 72/356; 72/370

[58] Field of Search ..... 72/353, 354, 356, 370, 72/361, 360; 308/6 C

[56] References Cited

U.S. PATENT DOCUMENTS

| | | | |
|---|---|---|---|
| 2,367,942 | 1/1945 | Hartman | 72/370 |
| 3,503,246 | 3/1970 | Shiokawa | 72/370 |
| 3,566,651 | 3/1971 | Tlaker | 72/370 |
| 3,719,979 | 3/1973 | Irwin | 308/6 C |
| 4,294,100 | 10/1981 | Olschewski | 72/367 |

*Primary Examiner*—Leon Gilden

*Attorney, Agent, or Firm*—Young & Thompson

[57] ABSTRACT

This invention relates to methods of making valve sleeves. The valve sleeve 35 is manufactured from a tube 10 which is initially placed on a mandrel 20, which is formed with axially-extending projections 23 spaced about it circumferentially. The tube is then swaged on to the mandrel to form grooves 28, which have the shape and the dimensions of 23. The mandrel 20 is then replaced by a cylindrical mandrel 30 and the open ends of grooves 28 are then closed by a further swaging operation. This method enables valve sleeves, having stopped axially-extending grooves in their inner surface with accurately located lips, to be formed from a single piece of metal.

5 Claims, 10 Drawing Figures

METHOD OF MAKING VALVE SLEEVES

This invention relates to methods of making valve sleeves and in particular, but not exclusively, valve sleeves for rotary high pressure valves, for example follow-up rotary servo valves as used in vehicle power-assisted steering mechanisms.

It is well known to form rotary valves using an outer valve sleeve and an inner core. Typically the valve sleeve is formed with axial grooves or slots, which co-operate with corresponding axial grooves on the core. Relative rotation of the core and sleeve cause selective opening or closing of the fluid passages. In many uses, particularly in a rotary follow-up valve, it is necessary for the sleeve to have internal axial grooves, rather than slots, so that discrete fluid connections can be made. One known method of manufacturing such a sleeve is by broaching grooves into the sleeve and then closing the ends by means of press-fitted rings. The procedure however suffers from several manufacturing and operating problems.

In addition in certain uses, for instance in hydraulic power steering gear, it is important or even essential that the grooves have accurately and precisely located lips so that the valve ports can be opened and closed quickly, simultaneously in unison, and at a precisely known position. This usually requires expensive machining.

It is an object of this invention to provide a method of forming a valve sleeve for a rotary valve, which overcomes or reduces at least some of these difficulties.

From one aspect the invention consists in a method of forming a valve sleeve for a rotary valve, comprising forming axially-extending grooves in the inner surface of a tube and deforming the tube to close or stop the or both ends of the grooves.

Preferably the constricted portion of the tube, which is deformed to close the ends of the grooves, is initially thicker than the central section of the tube, in which case there may be an inclined transition on the outside of the tube between the constricted portion and the central section.

In a preferred embodiment the grooves are themselves also formed by deforming the tube, for example by placing the tube on a mandrel having a number of axially-extending circumferentially-spaced projections which are shorter than the tube, and swaging the tube along the length of the mandrel to deform the tube to fill the spaces between the projections on the mandrel such that the resultant lands define the grooves between them. In this case the grooves are initially left open at at least one end to allow removal of the mandrel, and then the tube is further deformed to close one or both ends of the grooves for example by swaging on to a plain cylindrical mandrel. Conveniently the tube may be formed with a stepped bore having a reduced diameter portion of approximately the same diameter as the main body of the mandrel, so as to close or stop off the grooves at one end. The tube may be formed with a counter-bore at the other end, adjacent the opposite ends of the grooves, to ease the removal of the mandrel.

In any of these methods the grooves preferably have accurately-formed axially-extending lips and the tube may be formed of any suitable malleable material e.g. steel.

From a second aspect the invention consists in a method of forming a valve sleeve for a rotary valve comprising deforming the inner surface of a tube to form axially-extending grooves having stopped ends.

Preferably the grooves have accurately-formed lips.

The invention may be performed in various ways, and one specific embodiment will now be described by way of example with reference to the accompanying drawings, in which.

Figure 1:
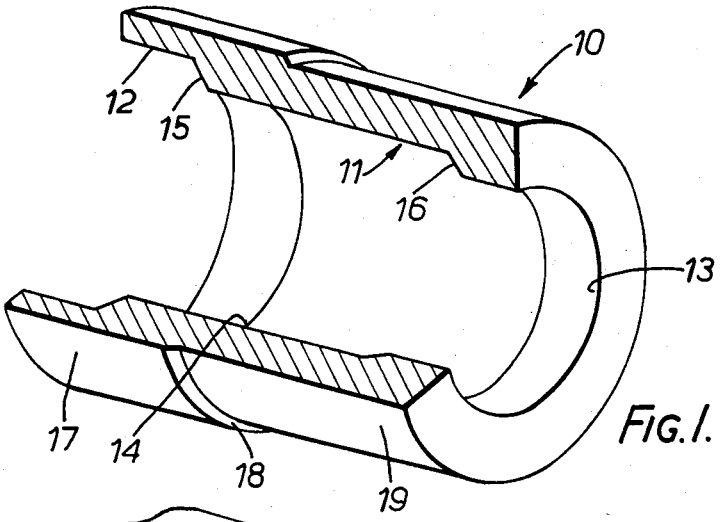
FIG. 1 is a part cut away perspective view of a tubular blank for use in manufacturing a valve sleeve by a method according to the invention.

FIG. 1 shows, at 10, a tube from which a grooved valve sleeve is to be formed. The tube 10, which may have been machined on an automatic lathe from bar stock or which may be an extrusion or moulding, has a bore 11. The bore 11 is provided with a counter-bore 12 at one end and a reduced diameter portion 13 at the other end. In each case there is an inclined transition between the end portions 12,13 and the central portion 14. The transitions 15 and 16 each slope towards the portion 13.

The tube 10 is also provided with an increased outer diameter part 17 which extends from the one end to a point beyond the transition 15 and then slopes at 18 down to the outer diameter of the main body 19 of the tube 10.

Figure 2:
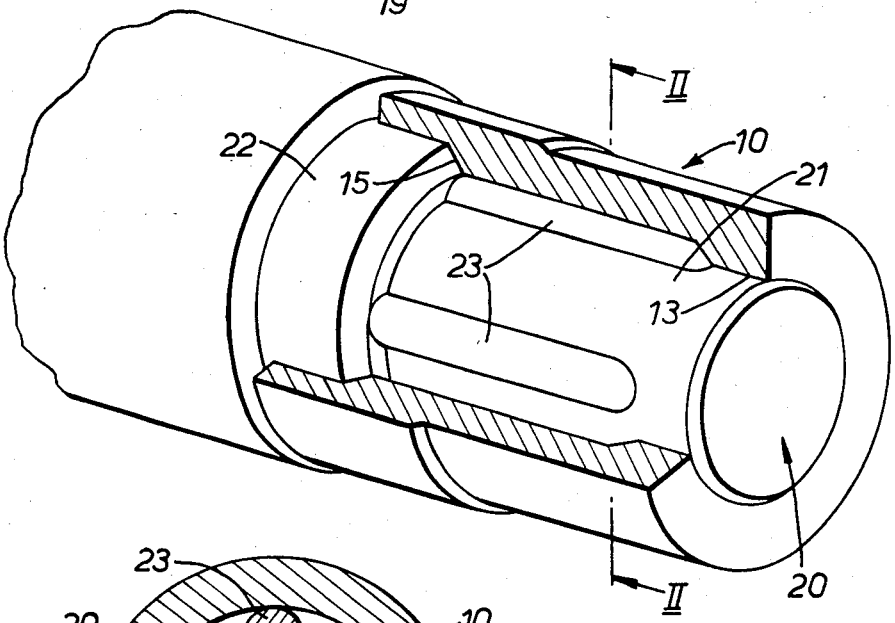
FIG. 2 is a perspective view showing the tube of FIG. 1 mounted on the mandrel.
Figure 3:
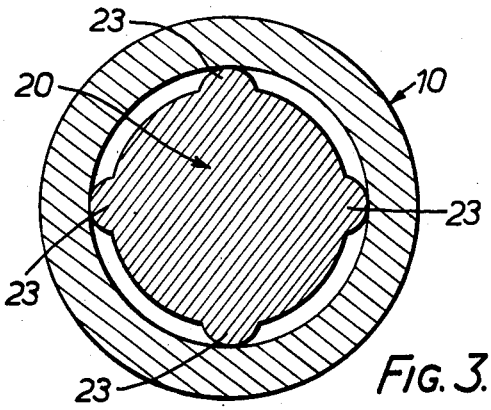
FIG. 3 is a section through FIG. 2 on the line II—II.
Figure 4:
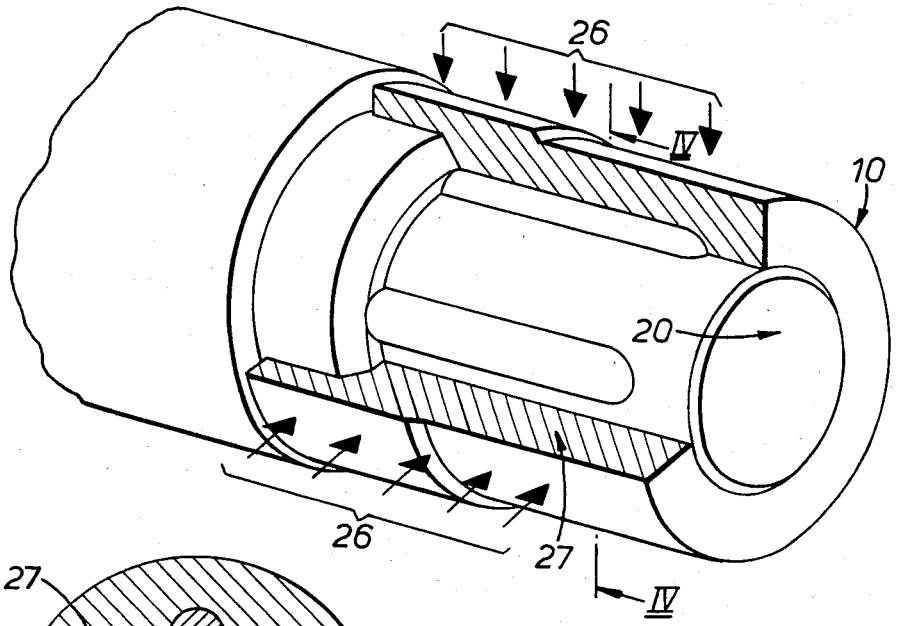
FIG. 4 shows the arrangement of FIG. 2 after a swaging force has been applied to the tube.
Figure 5:
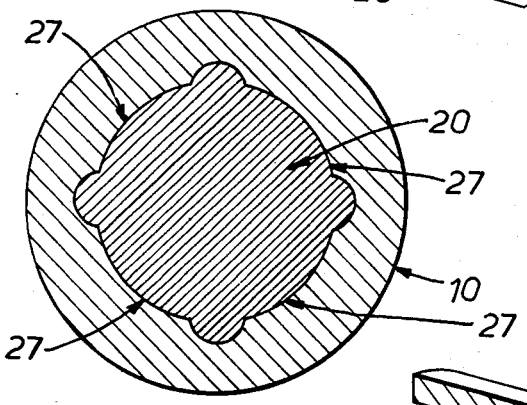
FIG. 5 is a section along the line IV—IV.

The tube 10 is placed on a mandrel 20 as shown in FIG. 2. The mandrel 20 has a cylindrical body 21 having approximately the same diameter as the reduced portion 13. The body 21 is dimensioned to extend from the portion 13 to the lowermost part of the transition slope 15, where it is provided with an enlarged portion 22 which fills the counter-bore 12. Axially-extending projections 23 are circumferentially spaced about the mandrel and extend from the enlarged portion 22 to the transition 16. As can best be seen in FIG. 3 the projections are of generally semi-circular section and have part spherical ends 24, which fit within the transition 16.

Figure 8:
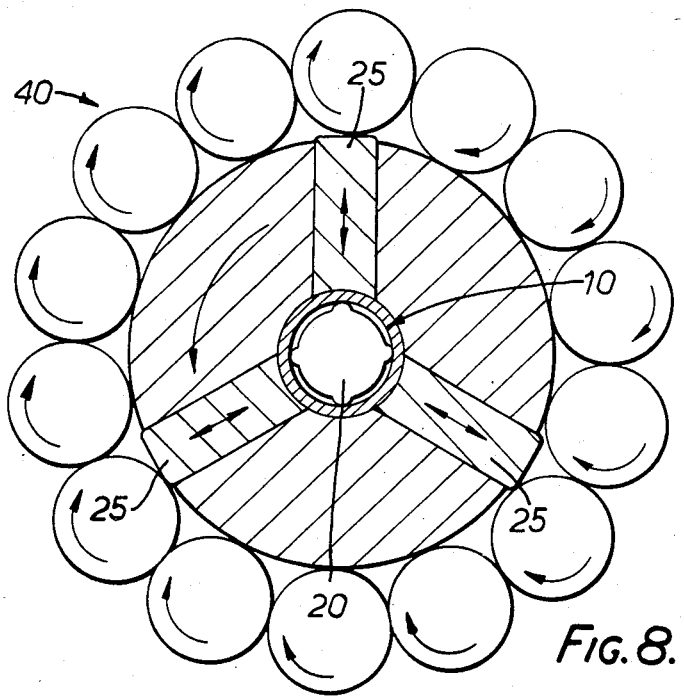
FIG. 8 is a diagrammatic cross-sectional view of the work head of an automatic rotary swaging machine.
Figure 9:
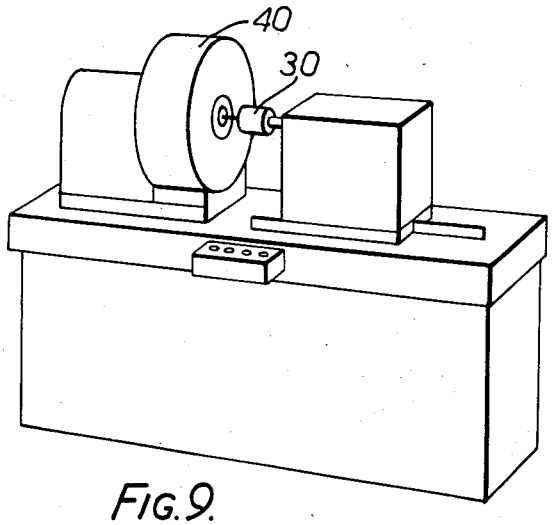
FIG. 9 shows one type of rotary swaging machine in which the jaws of FIG. 8 may be used.
Figure 10:
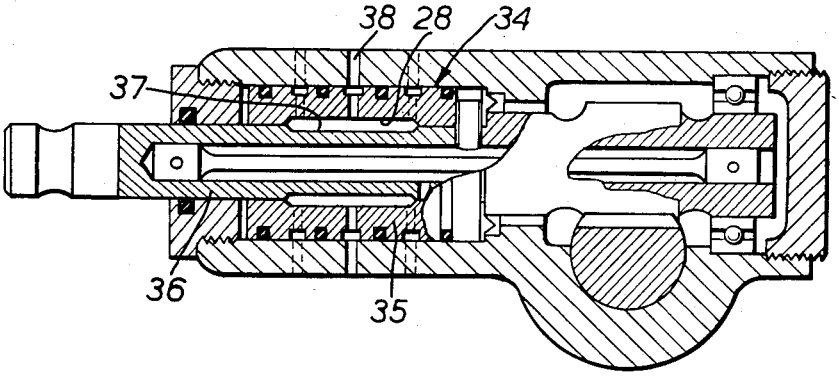
FIG. 10 shows a longitudinal sectional view of a rotary high pressure valve incorporating a valve sleeve.

The mandrel and tube assembly is placed within the jaws of a rotary swaging machine head 40, such as those shown at 25 in FIG. 8, and a swaging force, as indicated by arrows 26, is applied around the whole outside of the tube 10 over a length extending from the counter-bore 12 to the transition 16.

Figure 6:
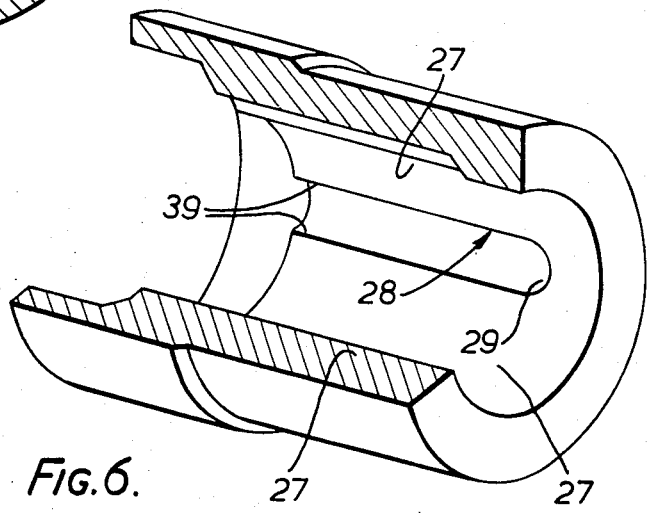
FIG. 6 is a perspective cut-away view of the tube of FIG. 1 after the deformation of FIG. 4.

This force causes the tube to be deformed radially inwardly between the projections forming lands 27. As can be seen in FIG. 6 these lands 27 define grooves 28, which have the shape and dimensions of the projections 23. One end 29 of each of the grooves 28 is closed or stopped by the transition 16.

Figure 7:
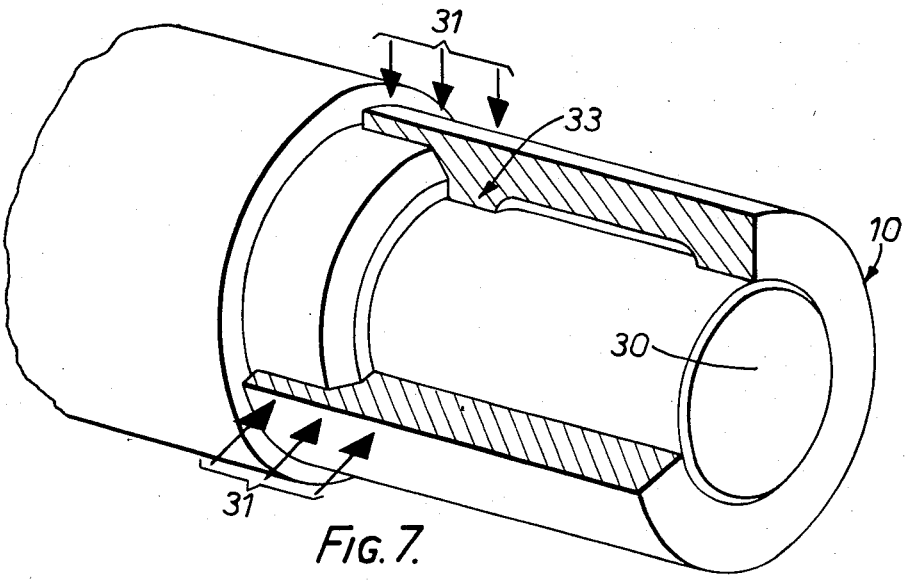
FIG. 7 shows the tube of FIG. 6 mounted on a second mandrel and after a second swaging force has been applied.

The deformed tube 10 is then placed on a second mandrel 30 as shown in FIG. 7. The second mandrel 30 is identical to the first mandrel 20, except that it has no projections 23.

The tube/mandrel assembly is again placed in the jaws 25 and a swaging force 31 is applied against the enlarged outer diameter part 17 forcing the additional material contained in this part radially inwardly at 33 to close or stop the other set of ends 33 of the grooves 28. The tube 10 is then ejected from the mandrel 30 and it will be seen, in FIG. 7, that it is now formed with a series of circumferentially spaced-axially-extending grooves having stopped ends.

The operation of such valves is generally well understood in the art, but basically relative rotation of the sleeve 35 and a core 36 causes fluid passages formed by the grooves 37 in the core and the grooves 28 in the sleeve to open and close, hence controlling the flow of hydraulic fluid between ports 38 in the various grooves 28. Such valves are commonly used in power steering devices where it is extremely important that lips 39 of the grooves 28 are accurately located so that the valve is opened or closed precisely.

It will be appreciated that the previously described method provides a simple and cheap way of manufacturing, from a single piece of metal, valve sleeves having stopped axially-extending grooves in their inner surface with accurately located lips.

Instead of providing a reduced diameter portion 13 it would be possible to swage each end of the tube 10 to provide the stopped ends of the grooves 28.

Alternatively by providing the mandrel with retractable projections the grooves could be swaged in a single step.

Although the method described above relates entirely to swaging deformation, any other suitable method of deformation may be used, for example the grooves may be punched or the ends of the grooves may be formed by localised peening.

In addition in some cases it may be advantageous to machine the grooves e.g. by broaching, and then to close the ends of the grooves by downward deformation of appropriate sections of the tube. In certain uses not all of the grooves in the sleeves need to be stopped at both ends.

I claim:

1. A method of forming a one piece valve sleeve for a rotary valve, comprising forming a tube having a generally annular portion defining a restricted aperture at one end, swaging the tube on a mandrel to form axially extending grooves having accurately formed lips in the inner surface of a tube so that one end of each groove is stopped by the annular portion and deforming the tube to stop the other ends of the grooves, the portion of the tube which is deformed to close the other ends of the grooves being initially thicker than the central section of the tube.

2. A method as claimed in claim 1 in which there is an inclined transition on the outside of the tube between the end forming portion and the central section.

3. A method as claimed in claim 1 in which the grooves are formed by placing the tube on a mandrel having a number of axially extending circumferentially spaced projections which are shorter than the tube and swaging the tube along the length of the mandrel to deform the tube to fill the spaces between the projections on the mandrel such that the resultant lands define the grooves between them.

4. A method as claimed in claim 3 in which grooves are initially left open at the other end to allow removal of the mandrel and the further deformation to close the other end of the grooves takes place after the removal of the mandrel.

5. A method as claimed in claim 4 in which the tube is formed with a counterbore at the other end to ease the removal of the mandrel.

* * * * *